US007766088B2

(12) United States Patent
Saucier et al.

(10) Patent No.: US 7,766,088 B2
(45) Date of Patent: Aug. 3, 2010

(54) SYSTEM AND METHOD FOR ACTUATING WELLBORE TOOLS

(75) Inventors: David Saucier, Mandeville, TX (US); James Sessions, Houston, TX (US); Dustin D. Ellis, Spring Branch, TX (US)

(73) Assignee: Baker Hughes Incorporated, Houston, TX (US)

( * ) Notice: Subject to any disclaimer, the term of this patent is extended or adjusted under 35 U.S.C. 154(b) by 214 days.

(21) Appl. No.: 11/176,094

(22) Filed: Jul. 7, 2005

(65) Prior Publication Data

US 2007/0007014 A1 Jan. 11, 2007

(51) Int. Cl.
*E21B 23/01* (2006.01)
*E21B 23/04* (2006.01)

(52) U.S. Cl. ..... 166/382; 166/373; 166/332.4

(58) Field of Classification Search ..... 166/373, 166/319, 332.4, 374, 382, 208
See application file for complete search history.

(56) References Cited

U.S. PATENT DOCUMENTS 3,223,170 A 12/1965 Mott
4,293,034 A 10/1981 Mott
4,305,465 A 12/1981 Ellis
4,583,593 A * 4/1986 Zunkel et al. ..... 166/382
4,862,966 A * 9/1989 Lindsey et al. ..... 166/382
5,146,992 A 9/1992 Baugh
5,413,180 A * 5/1995 Ross et al. ..... 166/387
5,845,722 A 12/1998 Makohl et al.
6,196,336 B1 3/2001 Fincher et al.
6,681,860 B1 * 1/2004 Yokley et al. ..... 166/382

* cited by examiner

*Primary Examiner*—Daniel P Stephenson
(74) *Attorney, Agent, or Firm*—Mossman, Kumar & Tyler, PC

(57) ABSTRACT

An actuator operatively coupled to a wellbore tool is activated upon receiving fluid that a predetermined applied pressure. When the fluid string reaches the predetermined applied pressure, the actuator undertakes a specified action such as longitudinal movement, rotation, expansion, etc. that actuates or operates the wellbore tool. Premature actuation of the wellbore tool is prevented by applying a resistive force to the actuator that, alone or in cooperation with another mechanism, arrests movement of the actuator. This resistive force is generated by applied pressure of the fluid in the work string.

23 Claims, 5 Drawing Sheets

SYSTEM AND METHOD FOR ACTUATING WELLBORE TOOLS

CROSS-REFERENCE TO RELATED APPLICATIONS

None

BACKGROUND OF THE INVENTION

1. Field of the Invention

The present invention relates to systems for actuating one or more tools adapted for use in a wellbore.

2. Description of the Related Art

Hydrocarbons such as oil and gas are recovered from a subterranean formation using a wellbore drilled into the formation. A number of tools are used throughout the process of drilling and completing the wellbore and also during the production life of the well. Many of these tools are energized using pressurized fluid that is self-contained in the tool, pumped downhole from the surface, or fluid that is produced from the well itself. These tools, which are sometimes referred to as hydraulically actuated tools, can be put to a number of uses.

One use for hydraulically actuated tools is to set a liner hanger. During drilling, the wellbore is lined with a string of casing that is cemented in place to provide hydraulic isolation and wellbore integrity. Commonly, multiple strings of casing are set in a well in a successive fashion. For example, a first string of casing is set in the wellbore after the well is drilled to a first depth and a second string of casing is run into the wellbore after the well is drilled to a second depth. The second string is set such that the upper portion of the second string of casing overlaps with the lower portion of the first string of casing. Any string of casing that does not extend back to the surface is generally referred to as a liner. The second string is then cemented into the wellbore as well. This process may be repeated as needed.

The liner hanger is used to hang or anchor a liner off of a string of other casing string. Several types of liner hangers are known in the art, which includes hydraulic liner hangers. In conventional hydraulic liner hangers, fluid is supplied under pressure into an annular space between a mandrel and a surrounding cylinder. The hydrostatic pressure of the fluid between the cylinder and the mandrel creates a force on the inner surface area of the cylinder that causes the cylinder to slide longitudinally.

Conventionally, the hydraulic liner hanger is set by applying a predetermined level of hydrostatic pressure to the liner hanger. That is, the liner hanger is run into the wellbore while in contact with a fluid having a first hydrostatic pressure and then actuated by increasing the pressure in the fluid. In an conventional arrangement, a ball is dropped into the wellbore and landed on a seat that is positioned generally downhole of the liner hanger. Fluid is then injected into the wellbore under pressure in order to actuate the hydraulic liner hanger.

Conventional hydraulic liner hangers can prematurely set if there is a pressure spike of sufficient magnitude in the drill string or if the pressure of the fluid external to the liner hanger unexpected drops. Conventional measures to prevent unintended setting of the liner hanger include the use of shear pins to mechanically restrain the cylinder while the liner assembly is run into the hole and closures or flow restriction devices that prevent fluid from entering the hydraulic liner hanger until the liner hanger is ready to be set.

These conventional measures have various drawbacks that include, but are not limited to, expense and tool complexity.

These conventional measures may also impose undesirable constraints in deployment of the liner hanger such as permissible bounds for drilling fluid circulation pressures and flow rates. Moreover, the drawbacks of conventional hydraulic liner hanger are merely illustrative of the general drawbacks of wellbore tools in general that operate using hydrostatic pressure while in the wellbore.

The present invention addresses these and other drawbacks of the prior art.

SUMMARY OF THE INVENTION

In aspects, the present invention provides systems, devices, and methods for actuating a wellbore tool. An exemplary actuator made in accordance with the present invention is operatively coupled to the wellbore tool and conveyed into a wellbore via a work string. When the fluid in the work string reaches a predetermined applied pressure, the actuator undertakes a specified action such as longitudinal motion, rotation, expansion, etc that actuates or operates the wellbore tool. Premature actuation of the wellbore tool is prevented by applying to the actuator a resistive force that, alone or in cooperation with another mechanism, arrests or restrains movement of the actuator. This resistive force is generated by applied pressure of the fluid in the work string.

In one arrangement adapted for use on a drill string, the actuator includes an actuating member having a first and a second pressure chamber. The actuator also includes a pressure control device that can control the pressure in the two chambers. The two pressure chambers are independently hydraulically coupled to the fluid in the drill string and are arranged such that the pressures in the chambers generate opposing forces, a motive force and a resistive force, on the actuating member. In one embodiment, the actuating member includes a cylinder slidably disposed on a mandrel. The pressure chambers, which are formed between the cylinder and mandrel, communicate with the drill string fluid via ports formed in the mandrel. When needed, the pressure control device forms a hydraulic seal between the two chambers by using, for example, a sealing member and occlusion member. This hydraulic seal hydraulically couples the first pressure chamber to the fluid uphole of the hydraulic seal. The fluid downhole of the hydraulic seal and the second pressure chamber are largely isolated from pressure increases in the uphole fluid due to the hydraulic seal.

To activate the actuator and thereby actuate the wellbore tool, the pressure in the first chamber is increased relative to the pressure in second chamber. For example, after the hydraulic seal is formed by the pressure control device, a surface pump can be energized to increase the applied pressure in the fluid uphole of the hydraulic seal. When so energized by the pressurized fluid, the magnitude of the motive force generated by the first pressure chamber increases. When an adequate pressure differential exists, the motive force overcomes the resistive force and the actuating member is thereby displaced. The displacement of the actuating member in turn actuates the wellbore tool.

The actuator can be configured to operate liner hangers as well as other tools used in the wellbore. Moreover, in addition to drilling fluid, the pressurized fluid can be water, synthetic material, hydraulic oil, or formation fluids.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
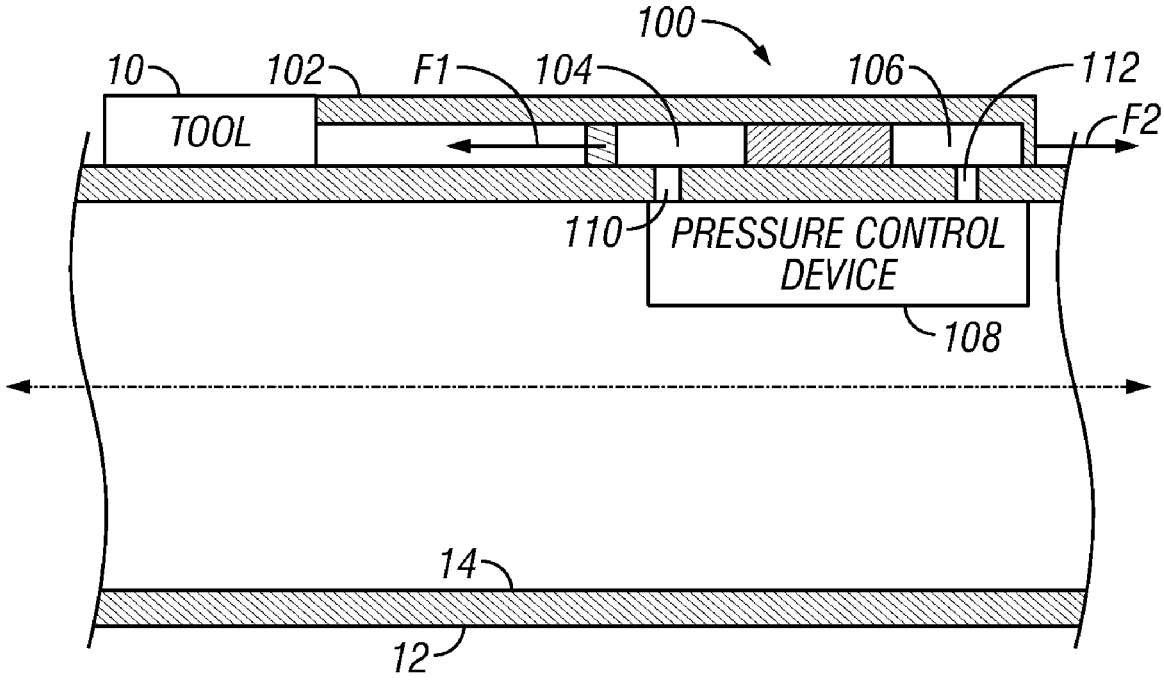
FIG. 1 schematically illustrates one embodiment of an actuating tool made in accordance with the present invention.

The present invention relates to devices and methods for actuating wellbore tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is schematically illustrated one embodiment of a tool actuator 100 made in accordance with the present invention for operating a tool 10 conveyed via a work string 12 into a wellbore. The tool actuator 100, as will be described in further detail below, operates in response to the applied pressure of the fluid. Applied pressure is generally defined as the total pressure applied by the fluid. The total pressure can be the hydrostatic pressure or can be the sum of several components such as hydrostatic pressure, dynamic pressure losses, and a pressure differentials caused by a device such as a surface mud pump or downhole pump. The actuator 100 includes an actuating member 102 connected directly or indirectly to the tool 10, a first pressure chamber 104, a second pressure chamber 106, and a pressure control device 108. The pressure control device 108 controls the pressure in each chamber 104 and 106. The pressures in chamber 104 and 106 each generate a force on the actuating member 102 that substantially oppose one another. When the two chambers 104 and 106 have generally equal pressures, the opposing forces balance and the actuating member 102 remains stationary. When desired, the pressure control device 108 can vary the pressure in one of the two chambers 104 and 106 to cause a net force that causes the actuating member 102 react in a preset manner such as sliding, rotating, extending, retracting, etc. The reaction of the actuating member 102 thereby actuates the tool 10.

In one arrangement, the actuator 100 is energized using pressurized fluid in a bore 14 of the work string 12. The first and second pressure chambers 104 and 106 hydraulically communicate with the bore 14 via ports 110 and 112, respectively. The first pressure chamber 104 generates a motive force F1 adapted to displace the actuating member 102 whereas the second pressure chamber 106 generates a resistive force F2 that temporarily or selectively offsets the force F1 created by the first pressure chamber 104. In such an arrangement, as long as chambers 104 and 106 communicate with pressurized fluid having the same hydraulic pressure, then the pressure values in the chambers 104 and 106 and corresponding generated forces will be substantially equal and the actuating member 102 will remain stationary, i.e., motion will be substantially arrested.

It should be appreciated that the actuating member 102 will remain stationary even if the applied pressure of the fluid in the bore 14 significantly and unexpectedly increases while the tool 100 is being run into the wellbore or sometime thereafter. This is so because the increased applied pressure will be applied to both chambers 104 and 106. Thus, while the magnitude of the motive force F2 may increase due to a pressure spike, the magnitude of the resistive force F2 will also increase since the applied pressure of the fluid that energizes the first pressure chamber 104 also energizes the second pressure chamber 106. Thus, the resisting force F2 will act to cancel the motive force F1 and thereby minimize the risk that the actuating member 102 will move. In like manner, if the pressure of the fluid external to the tool 100 unexpectedly drops, this pressure drop will not cause movement of the actuating member 102 because the second pressure chamber 104, and the resistive force it generates, arrests movement of the actuating member 102 using the applied pressure of the fluid internal to the tool 100.

When desired, the pressure control device 108 can cause a pressure imbalance or differential by allowing fluids having different applied pressures to communicate with each chamber 104 and 106. Upon the pressure differential reaching a preset or predetermined value, the net force generated by the first pressure chamber 104 overcomes the opposing force of the second pressure chamber 106 and displaces the actuating member 102, which then actuates the tool 10.

It should be understood that the pressure chamber 106 need not provide the exclusive resistive force or mechanism for offsetting the motive force F1. For instance, a biasing member or spring can be utilized to provide a preset amount of resistance against movement of the actuating member 102. Moreover, a shear pin or other frangible member can be used to increase the resistance the motive force F1 must overcome before displacing the actuating member 102. It should also be understood that the resisting force F2 does not necessarily cause motion of the actuating member 102. That is, the force F2 can act to maintain the actuating member 102 at a limit or end point of a stroke of the actuating member 102.

As will become apparent, the teachings of the present invention can be utilized for a variety of well tools and in all phases of well construction and production. Accordingly, the embodiments discussed below are merely illustrative of the applications of the present invention.

Figure 2A:
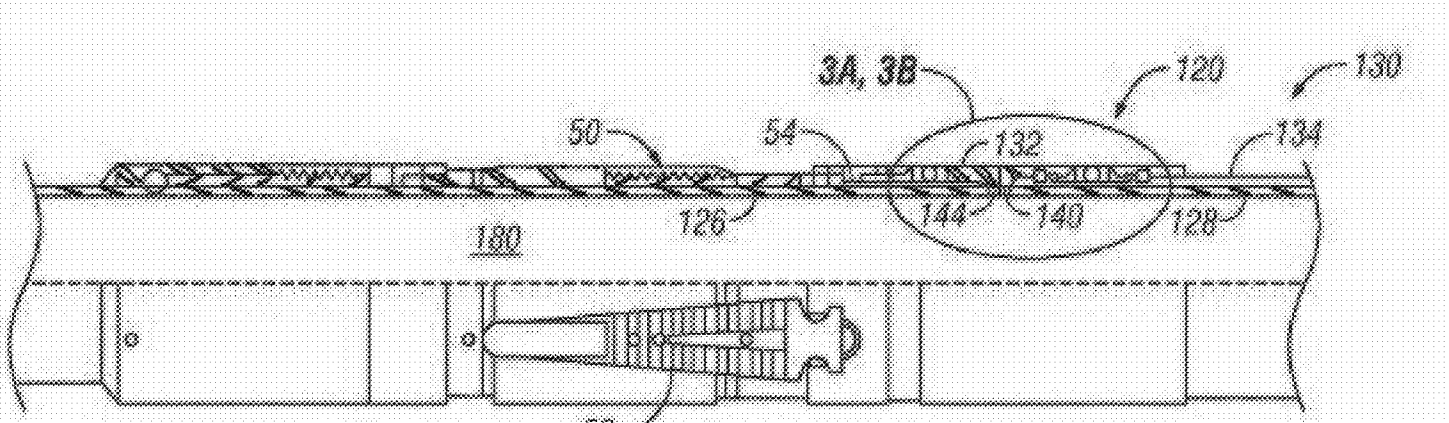
FIGS. 2A and 2B schematically illustrate sectional views of an embodiment of an actuating tool made in accordance with the present invention that is adapted for use in connection with a liner hanger.
Figure 2B:
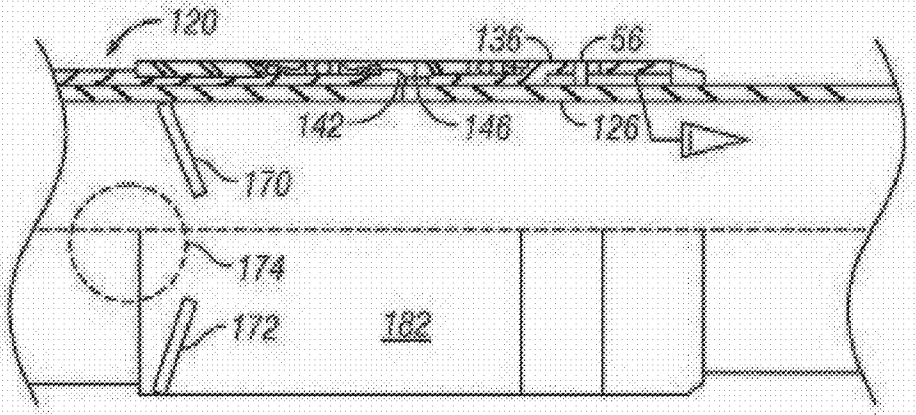

Referring now to FIGS. 2A and 2B, there is shown an embodiment of an actuator 120 adapted to actuate a liner hanger 50. The liner hanger is conventionally arranged and includes devices such as slips 52, a slip retainer 54, and a shear pin 56. A work string or other suitable conveyance device (not shown) can be used to convey this and other equipment into a wellbore. The actuator 120 is energized by the applied pressure of fluid in an inner bore 126 of the actuator 120. The actuator 120 is coupled to the slip retainer 54 and is configured to move the slips 52 longitudinally when the applied pressure in the bore 126 reaches a predetermined value. During this longitudinal movement, the slips 52 extend radially outward and engage a casing wall.

In one embodiment, the actuator 120 includes an inner mandrel 128 concentrically disposed within a surrounding cylinder 130. The cylinder 130 is adapted to slide longitudinally along the mandrel 128. For ease of assembly, the cylinder 130 includes an upper cylinder section 132, a spacer 134, and a lower cylinder section 136. The spacer 134 connects together the upper and lower cylinder sections 132 and 136 such that the cylinder 130 operates as one integral member. Other embodiments of the cylinder 130, of course, could have greater or fewer constituent parts. The actuator 120 includes a first pressure cavity or chamber 140 formed in the upper cylinder section 132 and a second pressure cavity or chamber 142 formed in the second cylinder section 136. Ports 144 and 146 formed in the inner mandrel 128 hydraulically couple the chambers 140 and 142 to the inner bore 126. As will be described in further detail below, a pressure imbalance or differential between the two chambers 140 and 142 create a net force that causes longitudinal movement of the cylinder 130.

Figure 3A:
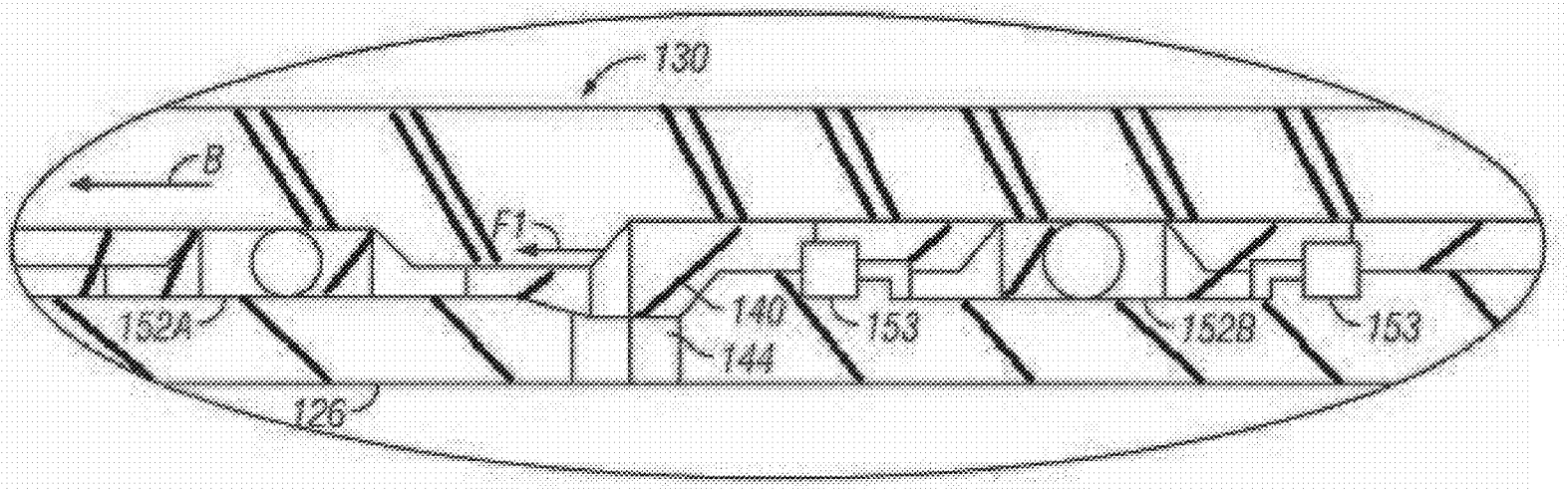
FIGS. 3A and 3B illustrate sectional views of embodiment of pressure chambers in accordance with the present invention.

Referring now to FIG. 3A, there is shown an exemplary arrangement of the chamber 140 for generating the motive force F1 for displacing the cylinder 130. During use, fluid in the bore 126 flows through the port 144 and fills the chamber 140. The hydraulic pressure of the fluid in the chamber 140 applies a force to the surfaces defining the chamber 140. Upon a predetermined pressure differential being caused between the chamber 140 and the chamber 142, the cylinder 130 moves longitudinally along the direction specified with arrow B. To prevent or minimize the fluid from leaking out of the chamber 140, the chamber can include seals 152A and 152B. In one embodiment, the seal 152A is a movable sealing element that moves generally with the cylinder 130 and the seal 152B is a stationary sealing element that is fixed to the inner mandrel 134 with suitable devices such as snap rings 153. It should be understood, however, that other embodiments having different sealing elements may be utilized and that in still other embodiments the sealing elements can be omitted entirely.

Figure 3B:
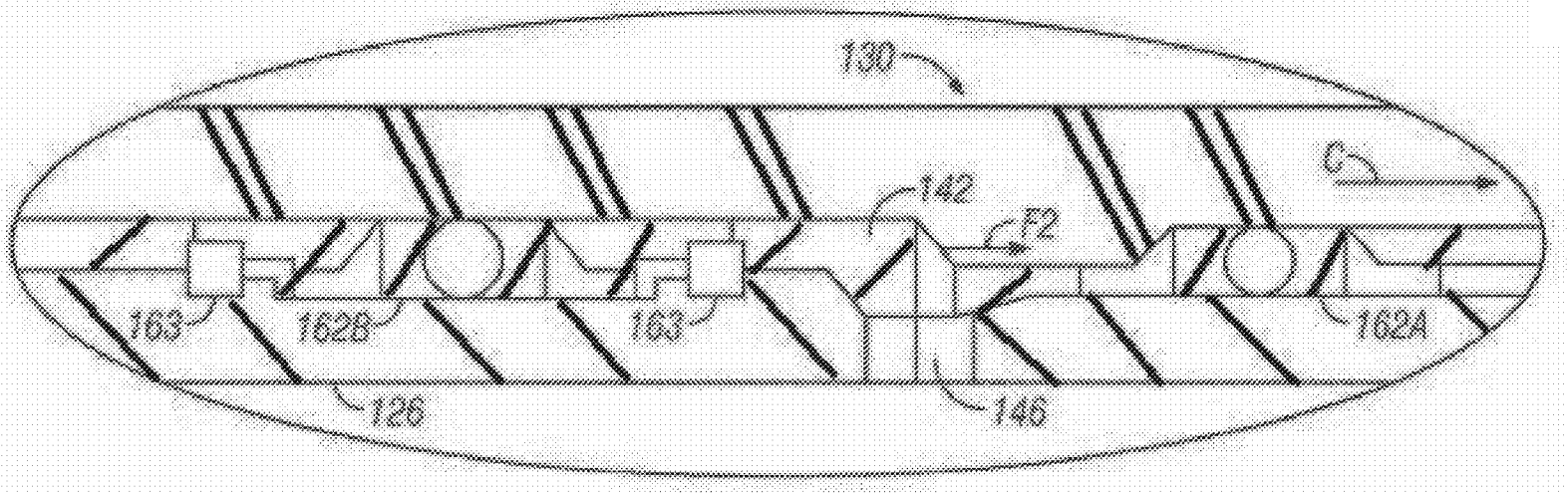

Referring now to FIG. 3B, there is shown an exemplary arrangement of the chamber 142 for providing a resisting force F2 that at least partially offsets the motive force F1 to at least temporarily arrest of restrain motion of the cylinder 130. During use, fluid in the bore 126 flows through the port 146 and fills the chamber 142. The hydraulic pressure of the fluid applies a force to the surfaces defining the chamber 142. This force urges the cylinder 130 in the direction specified with arrow C, which is substantially opposite of arrow B. Similar to the chamber 140, the chamber 142 can include seals 162A and 162B. In one embodiment, the seal 162A is a movable sealing element that moves generally with the cylinder 130 and the seal 162B is a stationary sealing element that is fixed to the inner mandrel 128 with suitable devices such as snap rings 163.

It will be understood that the magnitude of the pressure differential that initiates motion of the cylinder 130 will depend on factors such as frictional forces, the applied pressure external to the tool actuator 100, the shear strength of any shear pins that may be used to secure the slip assembly, etc.

Referring now to FIGS. 1,2A-2B, a pressure control device 170 selectively controls the pressures in the chambers 140 and 142. The pressure control device 170 is positioned between the ports 144 and 146 to thereby selectively hydraulically isolate the chambers to which the ports 144 and 146 respectively connect. The pressure control device 170 can maintain substantially equal pressures in the chambers 140 and 142 and also vary the pressure in either of the two chambers 140 and 142 to cause a pressure imbalance therebetween. For example, the pressure control device 170 can for one period of time maintain substantially equal pressures in the chambers 140 and 142 and in a successive period of time selectively increase the pressure in the chamber 140 or decrease the pressure in chamber 142. Numerous embodiments of the pressure control device 170 can be utilized, a few of which are discussed below.

Referring still to FIGS. 1,2A-2B, in one embodiment, the pressure control device 170 includes a sealing member 172 and an occlusion member 174 that cooperate to at least temporarily occlude the bore 126 of actuator 120. During run in of the wellbore tool 100 and before actuation is required, the sealing member 172 permits flow through the bore 126. To initiation activation of the actuator 120, the occlusion member 174 is introduced at the surface into the tubular connecting the actuator 120 to the surface (e.g., drill string, coiled tubing, production string, etc.). The occlusion member 174 travels down the tubular and mates with the sealing member 172, which has an opening or passage equal to or less than the size of the occlusion member 174. The occlusion member 174 can include a ball, a plug or other object configured to create a barrier across the sealing member 172.

When the occlusion member 174 and the sealing member 172 mate, a hydraulic seal is formed between the port 144 and the port 146. This seal, which does not need to be a "zero leakage" seal, enables a substantial pressure differential thereacross. Thus, the pressure chambers 140 and 142 are in communication with two hydraulically independent bodies of fluid. The two bodies of fluid need not be completely isolated from one another, e.g., there can be some fluid or hydraulic communication between the two fluid bodies.

Merely for convenience, the fluid in region 180, which communicates with the chamber 140, will be referred to as the uphole fluid and the fluid in region 182, which communicates with the chamber 142, will be referred to as the downhole fluid. The pressure of the uphole fluid can be controlled, e.g., increased, using a device such as a mud pump. Increasing the pressure of the uphole fluid will, of course, increase the pressure in the first chamber 140. Because of the seal provided by the pressure control device 170, the pressure of the downhole fluid and the fluid in the second chamber 142 remains mostly at hydrostatic pressure and are largely unaffected by the increased pressure in the uphole fluid.

Thus, initially, the motive force F1 and resistive force F2 will cancel due to the first and second chambers 140 and 142 receiving fluid having the same applied pressure. However, after occlusion of the bore 126, the increase of applied pressure in the uphole fluid and in the first chamber 140 will cause a corresponding increase in the magnitude of the force F1. Because the pressure in the downhole fluid is mostly static, the resistive force F2 does not change. At a predetermined pressure differential between the chambers 140 and 142, the motive force F1 overcomes the resistive force F2 and longitudinally displaces the cylinder 130. The cylinder 130 via its connection to the slip retainer 54 actuates or sets the slips 52.

It should be appreciated that the temporary occlusion in the well provides a hydraulic path to the chamber inducing the motive force while isolating or uncoupling the chamber inducing the resistive force from that hydraulic path. In addition to a surface pump increasing hydraulic pressure, other devices such as a downhole pump or even pyrotechnics can be used to selectively increase hydraulic pressure in that hydraulic path.

In one arrangement, after the slips 52 are set, pressure of the uphole fluid is further increased until the sealing member 172 deforms and allows the occlusion member 174 to pass therethrough. After the occlusion member 174 unseats and passes through the sealing member 172, hydraulic communication and fluid flow is reestablished along the bore 126. In certain embodiments, the sealing member 172 and occlusion member 174 can be configured to permit multiple selectively blockages of the bore 126.

Other selective bore restriction devices suitable for use in embodiments of the present invention are disclosed in U.S. Pat. No. 5,146,992 and U.S. patent application Ser. No. 10/602,578 filed Jun. 24, 2003, titled "Plug and Expel Flow Control Device," both of which are commonly assigned and are hereby incorporated by reference for all purposes.

Figure 4:
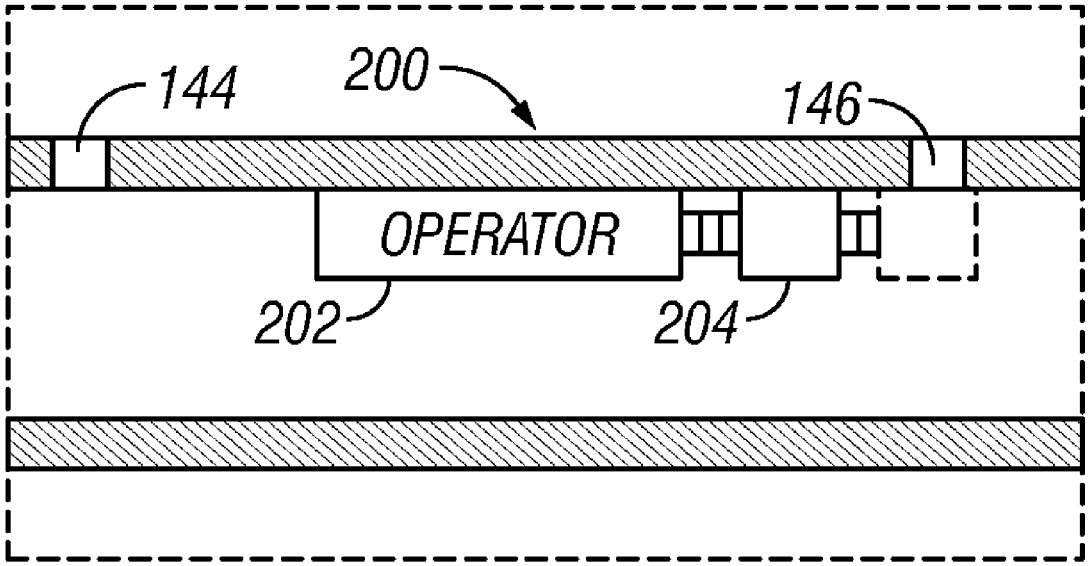
FIG. 4 schematically illustrates one embodiment of a pressure control device made in accordance with the present invention that uses a closure.

Referring now to FIG. 4, there is shown a pressure control device 200 including an operator 202 that selectively displaces a closure member 204. The closure member 204 is adapted to partially or completely seal the port 146 leading to the second pressure chamber 142 to thereby effectively isolate the second pressure chamber 142. The pressure control device 200 can be adapted for either "one time" usage or multiple sealing and unsealing of the port 146 and can include a mechanical device, electro-mechanical device, hydraulic motor or other suitable device. For example, the operator can include a biasing member that applies a spring force, a pressure chamber actuated by hydraulic fluid, an electric motor, frangible devices that restrain the closure member 204, etc.

Figure 5:
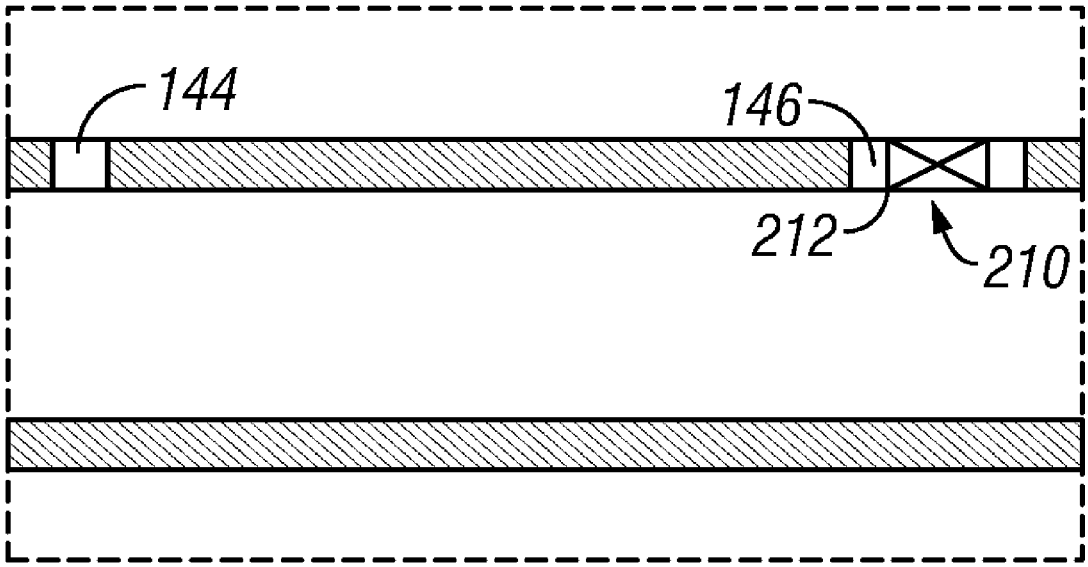
FIG. 5 schematically illustrates one embodiment of a pressure control device made in accordance with the present invention that uses a flow restriction device.

Referring now to FIG. 5, there is shown another embodiment of a pressure control device 210 that includes a flow restriction device 212 such as a valve that selectively controls flow across the port 146. The flow rate of the flow restriction device 212 can be adjusted using a solenoid or other suitable device. In still other embodiments, the pressure control device can merely include ports of differing cross-section flow areas. Referring now to FIGS. 3A-3B, for example, the port (or ports) for the chamber 140 can have a larger cross-sectional flow area than the port (or ports) for the chamber 142. The cross-sectional area differential can be selected such that the increase in hydraulic pressure in the bore is communicated faster to the chamber 140 than to chamber 142 to thereby provide a desired pressure differential between the chambers 140 and 142.

It should be appreciated that the pressure control device, whatever the particular configuration, can control the degree to which hydraulic pressure in the bore is communicated to the pressure chambers. Moreover, it should be appreciated that fluid communication between the bore and the chambers need not be completely blocked in order to cause a desired pressure differential.

Figure 6:
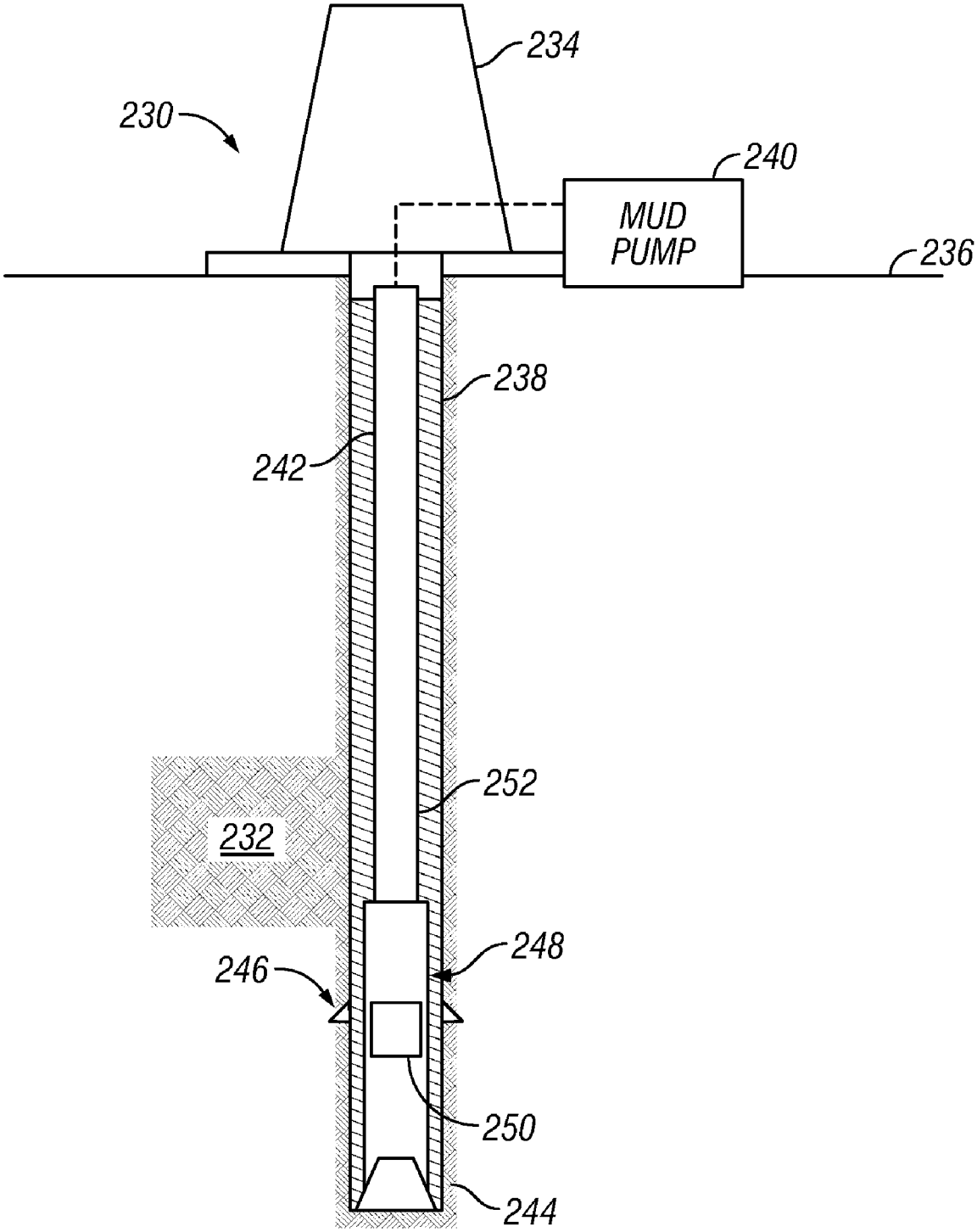
FIG. 6 schematically illustrates a sectional elevation view of a liner drilling system utilizing an actuating tool made in accordance with the present invention.

Referring now to FIG. 6, there is shown a well construction facility 230 positioned over subterranean formation 232. While the facility 230 is shown as land-based, it can also be located offshore. The facility 230 can include known equipment and structures such as a derrick 234 at the earth's surface 236, a casing 238, and mud pumps 240. A work string 242 suspended within a well bore 244 is used to convey tooling and equipment into the wellbore 244. The work string 242 can include jointed tubulars, drill pipe, coiled tubing, production tubing, liners, casing and can include telemetry lines or other signal/power transmission mediums that establish one-way or two-way data communication and power transfer from the surface to a tool connected to an end of the work string 242. A suitable telemetry system (not shown) can be known types as mud pulse, electrical signals, acoustic, or other suitable systems. The tooling and equipment conveyed into the wellbore can include, but are not limited to, bottomhole assemblies, tractors, thrusters, steering units, drilling motors, downhole pumps, completion equipment, perforating guns, tools for fracturing the formation, tools for washing the wellbore, screens and other production equipment.

For illustrative purposes, the work string 242 is shown as including a drill string conveying a bottomhole assembly adapted for liner drilling ("liner drilling assembly") 246 into the wellbore 244. Exemplary liner drilling systems are discussed commonly assigned U.S. Pat. Nos. 5,845,722 and 6,196,336, which are hereby incorporated by reference for all purposes. The liner drilling assembly 246 includes a liner hanger 248 and an actuator 250.

Referring now to FIGS. 2-6, in an exemplary deployment, the liner drilling assembly 246 drills the wellbore 244 while the mud pump 240 circulates drilling fluid down the drill string 242. The drilling fluid and entrained drill cuttings return up an annulus 252 formed by the drill string 242 and the wellbore 244. During drilling, both pressure chambers 140, 142 of the actuator 120 communicate with the drilling fluid in the drill string 244 and thus both pressure chambers 140, 142 have approximately the same applied pressure as the drilling fluid in the drill string 242. Accordingly, the opposing forces created by the pressures in the first and second chambers 140, 142 are substantially equal and balance each other. Thus, advantageously, the actuator 120 remains substantially stationary regardless of the applied pressure value or pressure fluctuations inside the drill string 242.

Once the liner drilling assembly 246 drills to a desired depth, the liner hanger 248 can be actuated in the following manner. In embodiments utilizing occlusion of the bore 126, such as in FIG. 2A and 2B, drilling is halted and the occlusion member 174 is "dropped" into the drill string 242. The occlusion member 174 flows down through the drill string 242 until it mates with the sealing member 172 to form an occlusion in the drill string 242 that hydraulically separates the first pressure chamber 140 from the second pressure chamber 142. Thereafter, the mud pump 240 is operated to increase the applied pressure of the drilling fluid in the drill string 242. Because of the occlusion, the applied pressure will increase only in the drilling fluid column inside the drill string 242 and uphole of the occlusion. The drilling fluid column in the drill string 242 and below the occlusion will remain at a lower applied pressure. Because the first pressure chamber 140 communicates with the fluid uphole of the occlusion, the applied pressure in first pressure chamber 140 increases relative to the pressure in the second pressure chamber 142, which is communication with the drilling fluid downhole of the occlusion. Once a sufficient pressure differential is created between the first and second pressure chambers 140, 142, the net force applied by the first pressure chamber 140 urges the cylinder 130 longitudinally toward the slips 52. Via the slip retainer 54, the cylinder 130 drives the hanger slips 52 into engagement with the casing 238.

In addition to being largely immune from pressure fluctuations during drilling, the actuator 120 also cannot be inadvertently actuated by pressure fluctuations when the liner drilling assembly 248 and drill string 244 are run into the hole (e.g., due to surge).

It should be appreciated that embodiments of the present invention provide numerous operational and situational advantages. For example, during drilling, formations having relatively a low fracture pressure could be encountered. In such a situation, increasing the pressure in the wellbore to set a liner hanger could expose the formation to excessive applied pressures. With embodiments of the present invention, it should be seen that the increased applied pressure used for actuating the tool actuator and thereby setting the liner hanger is confined mostly within the drill string. Thus, the formation is largely protected from damage that would otherwise occur if exposed to applied pressure in excess of the formation fracture pressure.

In another example, during drilling, the hydrostatic pressure external to the drill string could be significantly lower than the hydrostatic pressure within the drill string. Such a situation could arise, for instance, where drilling fluid lost to the formation reduces the hydrostatic pressure of the drilling fluid flowing up the wellbore annulus. Because operation of the tool actuator is initiated by actively controlling pressure within the drill string, the tool actuator is largely immune to the value the hydrostatic pressure of fluid external to the drill string or tool actuator. That is, even a dramatic drop in external pressure will not induce movement of the actuator since the resistive force opposing movement utilizes hydrostatic pressure within the actuator to prevent unintended activation of the actuator.

It should further appreciated that the teachings of the present invention can be readily applied to numerous tools outside the liner drilling context. For example, in certain applications, fluids such as water, acids, fracturing fluids, may be circulated in the wellbore. Also, formation fluids such as oil and water can be utilized in some circumstances to energize the actuator.

Some embodiments of the present invention can be adapted for use in situations where fluid pressure is not used to energize a tool or device. For example, some tools may be actuated or energized by vibrations, mud pulse, motion of the tool, frequency, electronic signals, etc. Aspects of the present invention, including, but not limited to the use of opposing forces, can be advantageously applied in such circumstances.

Further, it should be understood that while the embodiments described illustrate only two pressure chambers, additional pressure chambers can be added to further extend the utility of devices made in accordance with the present invention. In the same regard, while actuation of the a wellbore tool has been described, embodiments of the present invention can be readily adapted to return a wellbore tool to a condition prior to actuation (e.g., turn a tool on and off, set and set a tool, etc.)

Additionally, it should be understood that the terms such as "first" and "second" and "uphole" and "downhole" do not signify any specific priority, importance, or orientation but are merely used in better describe the relative relationships between the items to which they are applied. Also, the term longitudinal generally refers to a direction along the long axis of a wellbore or tool, but as noted above, the actuator is not limited to motion in any particular direction.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

The invention claimed is:

1. A method for actuating a wellbore tool, comprising:

conveying the wellbore tool and an actuator into a wellbore using a tubular, the actuator being operatively coupled to the wellbore tool, wherein the actuator includes a first pressure chamber adapted to generate a motive force for activating the actuator and a second pressure chamber adapted to generate a resistive force for resisting the activation of the actuator;

generating the resistive force at least partially using an applied pressure of a fluid in the wellbore;

isolating the first pressure chamber from the second pressure chamber using an occlusion member;

activating the actuator by increasing an applied pressure uphole of the occlusion member while the second pressure chamber is in communication with a fluid downhole of the occlusion member; and increasing the pressure uphole of the occlusion member to displace the occlusion member.

2. The method of claim 1 further comprising operating a pump at the surface to increase a pressure in the wellbore, wherein the actuator is activated by the increased applied pressure applied to the actuator.

3. The method of claim 1 further comprising using a work string to convey the wellbore tool and the actuator into the wellbore; and pumping the fluid into the work string.

4. The method of claim 1 wherein the isolation creates a first fluid column in communication with the first pressure chamber and a second fluid column in communication with the second pressure chamber, the first fluid column being separated from the second fluid column.

5. The method of claim 1 further comprising hydraulically isolating the second pressure chamber from the fluid uphole of the occlusion member.

6. The method of claim 1 wherein the first pressure member and the second pressure chamber are axially spaced apart.

7. The method of claim 1 further comprising reestablishing fluid flow in the tubular by passing the occlusion member through the actuator.

8. The method of claim 1 wherein a first pressure activates the actuator and a second pressure greater than the first pressure displaces the occlusion member.

9. An apparatus for actuating a tool adapted for use in a wellbore, comprising:

an actuator operatively coupled to the wellbore tool;

a first pressure chamber configured to generate a motive force that displaces the actuator;

a second pressure chamber configured to generate a resistive force that resists motion of the actuator;

a pressure control device configured to allow an increase in an applied pressure to the first pressure chamber while the second pressure chamber is in communication with the fluid downhole of the pressure control device, wherein the pressure control device is configured to receive an occlusion member that selectively isolates the first pressure chamber from the second pressure chamber, wherein the occlusion member is configured to pass through the pressure control device in response to a pressure increase in the fluid uphole of the occlusion member.

10. The apparatus of claim 9 wherein the actuator includes an actuating member.

11. The apparatus of claim 9 wherein the actuator includes a cylinder slidably disposed on a mandrel, the first and second pressure chambers being formed there between.

12. The apparatus of claim 11 further comprising a first and second port formed in the mandrel that is configured to provide fluid communication between a fluid body and the first and second pressure chambers, respectively.

13. The apparatus of claim 12 wherein the pressure control device is configured to substantially hydraulically isolate the first pressure chamber from the second pressure chamber.

14. The apparatus of claim 12 wherein the pressure control device includes a sealing member positioned between the first and second ports, the sealing member being configured to receive the occlusion member.

15. The apparatus of claim 9 wherein the first pressure chamber is configured to generate a motive force that displaces the actuator upon receiving fluid at a predetermined applied pressure.

16. The apparatus of claim 9 wherein the tool is a liner hanger.

17. A system for operating a tool for use in a wellbore, comprising:

(a) a rig at a surface location;

(b) an actuator coupled to the tool, the actuator including a first and second pressure chamber in communication with a fluid in the work string, the first and second chambers adapted to generate forces in substantially opposing directions;

(c) a work string adapted to convey the tool and the actuator into the well bore from the rig; and (d) a pressure control device adapted to selectively substantially hydraulically isolate the first and second pressure chambers from each other, the pressure control device being configured to allow an increase in an applied pressure to the first pressure chamber while the second pressure chamber is in communication with the fluid downhole of the pressure control device; and (e) an occlusion member cooperating with the pressure control device to selectively isolate the first pressure chamber from the second pressure chamber, wherein the occlusion member is configured to pass through the pressure control device in response to a pressure increase in the fluid uphole of the occlusion member.

18. The system according to claim 17 further comprising a pump at the surface location adapted to selectively increase an applied pressure of the fluid in the work string.

19. The system according to claim 17 further comprising a liner drilling assembly coupled to the work string; and wherein the tool is a liner hanger associated with the liner drilling assembly.

20. The system according to claim 19 wherein the actuator includes a cylinder slidably mounted on a mandrel, the first and second pressure chambers being formed there between.

21. The system according to claim 20 wherein the liner hanger includes slips adapted to extend radially upon a sliding motion of the cylinder.

22. The system according to claim 17 wherein the pressure control device includes a sealing member adapted to receive the occlusion member, the mating of the occlusion member and the sealing member substantially hydraulically sealing the first pressure chamber from the second pressure chamber.

23. A method for actuating a wellbore tool, comprising:

operatively connecting an actuator to the wellbore tool, wherein the actuator includes a first pressure chamber adapted to generate a motive force for activating the actuator and a second pressure chamber adapted to generate a resistive force for resisting the activation of the actuator; hydraulically coupling the first pressure chamber and the second pressure chamber to a bore of the wellbore tool;

conveying the wellbore tool and the actuator into a wellbore using a tubular;

allowing flow through the bore of the wellbore tool while the wellbore tool is conveyed into the wellbore;

generating the resistive force at least partially using an applied pressure of a fluid in the bore;

isolating the first pressure chamber from the second pressure chamber using an occlusion member;

increasing an applied pressure uphole of the occlusion member to activate the actuator; and increasing the pressure uphole of the occlusion member to displace the occlusion member and reestablish flow in the bore of the tubular.

* * * * *